US012648634B2

(12) United States Patent
Jung et al.

(10) Patent No.: US 12,648,634 B2
(45) Date of Patent: Jun. 9, 2026

(54) BAG

(71) Applicant: DONG-IN ENTECH CO., LTD., Gyeonggi-do (KR)

(72) Inventors: In Soo Jung, Gyeonggi-do (KR); In Seok Choi, Busan (KR); Min Gon Kang, Daegu (KR)

(73) Assignee: DONG-IN ENTECH CO., LTD., Gyeonggi-do (KR)

( * ) Notice: Subject to any disclaimer, the term of this patent is extended or adjusted under 35 U.S.C. 154(b) by 106 days.

(21) Appl. No.: 18/682,390

(22) PCT Filed: Aug. 12, 2022

(86) PCT No.: PCT/KR2022/012107
§ 371 (c)(1),
(2) Date: Mar. 20, 2024

(87) PCT Pub. No.: WO2023/018290
PCT Pub. Date: Feb. 16, 2023

(65) Prior Publication Data

US 2024/0349874 A1 Oct. 24, 2024

(30) Foreign Application Priority Data

Aug. 13, 2021 (KR) ..... 10-2021-0107478
Dec. 6, 2021 (KR) ..... 10-2021-0173126

(51) Int. Cl.
*A45F 3/04* (2006.01)
*A45F 3/08* (2006.01)

(52) U.S. Cl.
CPC ..... *A45F 3/047* (2013.01); *A45F 3/08* (2013.01)

(58) Field of Classification Search
CPC .... A45F 3/047; A45F 3/08; A45F 3/04; A45F 3/14
See application file for complete search history.

(56) References Cited

U.S. PATENT DOCUMENTS 5,632,429 A * 5/1997 Cantwell ..... A45C 13/30 224/264
9,545,144 B2 * 1/2017 Gill ..... A45F 3/04
(Continued)

FOREIGN PATENT DOCUMENTS

CN 203262523 U 11/2013
CN 209378010 U * 9/2019
(Continued)

OTHER PUBLICATIONS

Extended European Search Report for the European Patent Application No. 22856283.1 issued by the European Patent Office on Jul. 11, 2025.

*Primary Examiner* — William L Miller
(74) *Attorney, Agent, or Firm* — IP & T GROUP LLP

(57) ABSTRACT

A bag according to one aspect of the present invention may include: a bag body provided with a back plate portion and a storage space for storing items; a shoulder slinging portion including a backrest portion corresponding to the back plate portion and a shoulder strap connected to the backrest portion; and a first coupling portion connecting the back plate portion and the backrest portion in a height-adjustable manner, wherein the first coupling portion includes: a first body coupling portion coupled to the back plate portion; and a backrest coupling portion coupled to the backrest portion, and the first body coupling portion includes a plurality of coupling areas to which the backrest coupling portion is coupled and provided at different heights.

12 Claims, 17 Drawing Sheets

(56) References Cited

U.S. PATENT DOCUMENTS

| | | | | |
|---|---|---|---|---|
| 10,342,318 | B2 * | 7/2019 | Winfield | A45F 3/047 |
| 10,849,410 | B2 * | 12/2020 | Ng | A45C 13/001 |
| 12,364,322 | B2 * | 7/2025 | Keidel | A45F 3/04 |
| 2002/0033404 | A1 | 3/2002 | Lafoux et al. | |
| 2009/0095780 | A1 * | 4/2009 | Wangeby | A45F 3/14 224/264 |
| 2009/0200348 | A1 * | 8/2009 | Smith | A41D 13/0537 224/257 |
| 2016/0033235 | A1 * | 2/2016 | Kinnings | A45F 3/12 2/102 |
| 2018/0184787 | A1 | 7/2018 | Winfield | |
| 2019/0041167 | A1 * | 2/2019 | Swan | F41H 5/013 |
| 2020/0103073 | A1 * | 4/2020 | Lennings | A45F 3/08 |
| 2020/0196739 | A1 * | 6/2020 | Hong | A45F 3/047 |
| 2020/0337445 | A1 * | 10/2020 | Chang | A45F 3/10 |
| 2024/0041189 | A1 * | 2/2024 | Schwager | A45F 3/047 |
| 2024/0407535 | A1 * | 12/2024 | Hata | H01M 50/204 |
| 2025/0017339 | A1 * | 1/2025 | Zhang | A45F 3/047 |
| 2025/0194779 | A1 * | 6/2025 | Johansson | A45F 3/14 |

FOREIGN PATENT DOCUMENTS

| | | | | |
|---|---|---|---|---|
| DE | 202015007090 | U1 * | 1/2017 | A45F 3/047 |
| JP | 6829122 | B2 | 2/2021 | |
| KR | 20-0434625 | Y1 | 12/2006 | |
| KR | 10-1162591 | B1 | 7/2012 | |
| KR | 10-1450000 | B1 | 10/2014 | |
| KR | 10-1484404 | B1 | 1/2015 | |
| KR | 20160094772 | A | 8/2016 | |
| KR | 20160115160 | A | 10/2016 | |
| WO | WO-2023018290 | A1 * | 2/2023 | A45F 3/047 |

* cited by examiner

BAG

This application is a national stage application of PCT/KR2022/012107 filed on Aug. 12, 2022, which claims priority to Korean Patent Application No. 10-2021-0107478 filed on Aug. 13, 2021, and Korean Patent Application No 10-2021-0173126 filed on Dec. 6, 2021. The disclosure of each of the foregoing applications is incorporated herein by reference in its entirety.

TECHNICAL FIELD

The present invention relates to a bag.

BACKGROUND ART

In general, bags are convenient to carry because they can be slung on the shoulders while storing necessary items, and they can be used for storing and transporting items.

These bags are one of the basic yet very important pieces of equipment used to transport items when a user stays outdoors, such as hiking or fishing, and are generally referred to as backpacks.

Users need to prepare bags suitable for the weight and type of items, the conditions of the travel destination, and the duration of the travel.

This is because the degree to which the weight of the items accommodated in a bag is transmitted to the body varies and the wearing sensation is significantly different depending on the structure of the bag, so the fatigue felt by the human body when wearing the bag is significantly different.

DISCLOSURE

Technical Problem

The present invention was created to solve the problems of the prior art as described above, and one object of the present invention is to provide a bag whose wearing sensation may be adjusted.

Technical Solution

A bag according to one aspect of the present invention may include: a bag body provided with a back plate portion and a storage space for storing items; a shoulder slinging portion including a backrest portion corresponding to the back plate portion and a shoulder strap connected to the backrest portion; and a first coupling portion connecting the back plate portion and the backrest portion in a height-adjustable manner, wherein the first coupling portion includes: a first body coupling portion coupled to the back plate portion; and a backrest coupling portion coupled to the backrest portion, and the first body coupling portion includes a plurality of coupling areas to which the backrest coupling portion is coupled and provided at different heights.

Specifically, the backrest coupling portion may include: a first fixture provided in the outside direction of the backrest portion; a second fixture provided in the direction of the back plate portion of the backrest plate and provided with a circular protruding portion provided in the direction of the back plate portion; and a rotational coupling body coupled to the protruding portion.

Specifically, the rotational coupling body may have: a central portion having a shape corresponding to the protruding portion; and a wing portion connected to both sides of the central portion.

Specifically, the wing portion may have a shape in which a part of a concentric circle having a larger diameter than the diameter of the central portion is sectioned.

Specifically, the first body coupling portion may include: a first base portion provided inside the storage space and divided into a plurality of areas arranged in one direction; a plurality of rotation limiting portions including a first protrusion corresponding to the central portion and second protrusions provided on both sides of the first protrusion to limit rotation of the wing portion, and disposed in each of the areas; an elastic member provided between the first base portion and the rotation limiting portions; a protrusion place-in/place-out plate including open areas corresponding to the first protrusion and the second protrusions to allow the first protrusion and the second protrusions to be placed in and out, and provided inside the storage space; a spacing plate providing a plurality of open rotation spaces to allow the rotational coupling body to rotate and provided inside the storage space; and a second base portion including a plurality of insertion areas that correspond to the coupling area of the first body coupling portion and are open in a shape corresponding to the rotational coupling body.

Specifically, the first body coupling portion may include: a first base portion provided inside the storage space and forming a closed space; a plurality of rotation limiting portions including a first protrusion corresponding to the central portion and including an empty space therein, and second protrusions provided on both sides of the first protrusion to limit rotation of the wing portion; a protrusion adjusting portion penetrating the first base portion, engaging with the empty space of the first protrusion, and connected to the first protrusion and the second protrusions; an elastic member provided between the first base portion and the rotation limiting portions; a protrusion place-in/place-out plate including open areas corresponding to the first protrusion and the second protrusions to allow the first protrusion and the second protrusions to be placed in and out, and provided inside the storage space; a spacing plate providing a plurality of open rotation spaces to allow the rotational coupling body to rotate and provided inside the storage space; and a second base portion including a plurality of insertion areas that correspond to the coupling area of the first body coupling portion and are open in a shape corresponding to the rotational coupling body.

Specifically, the protruding height of the first protrusion and the second protrusions may be lowered by the operation of the protrusion adjusting portion, so that the rotational coupling body may rotate in the plurality of open insertion areas.

Specifically, the protruding height of the first protrusion may be smaller than the protruding height of the second protrusions.

Specifically, the second protrusions of the rotation limiting portion may have a shape in which a part of a concentric circle having a larger diameter than the diameter of the central portion is sectioned, and may be smaller than the width of the wing portion of the rotational coupling body.

Specifically, the rotation limiting portion may have a shape extending in a direction perpendicular to the direction in which the areas of the first base are arranged, and the first protrusion and the second protrusions may be provided in a flat area of the rotation limiting portion.

Specifically, the thickness of the protrusion place-in/place-out plate may be smaller than the protruding heights of the first protrusion and the second protrusions.

Specifically, the bag may further include: a waist belt portion provided corresponding to the lower portion of the back plate portion; and a second coupling portion connecting the waist belt portion and the back plate portion, wherein the second coupling portion may include a waist belt coupling portion coupled to a part of the waist belt portion and having the same configuration as the backrest coupling portion; and a second body coupling portion having substantially the same structure as the first body coupling portion but having a smaller coupling area than the coupling area of the body coupling portion.

Specifically, the bag may further include: a waist cushion portion attached to the lower portion of the back plate portion; and a slip preventing pattern provided on the surface of the waist cushion portion.

Advantageous Effects

As described above, in the bag according to the present invention, it is possible to adjust the position at which a bag body and a shoulder slinging portion are connected, thereby adjusting a user's bag wearing sensation.

In addition, even when a user moves while wearing the bag, the bag may maintain a state of being perpendicular to the ground, thereby reducing fatigue caused by wearing the bag.

MODES OF THE INVENTION

Figure 1:
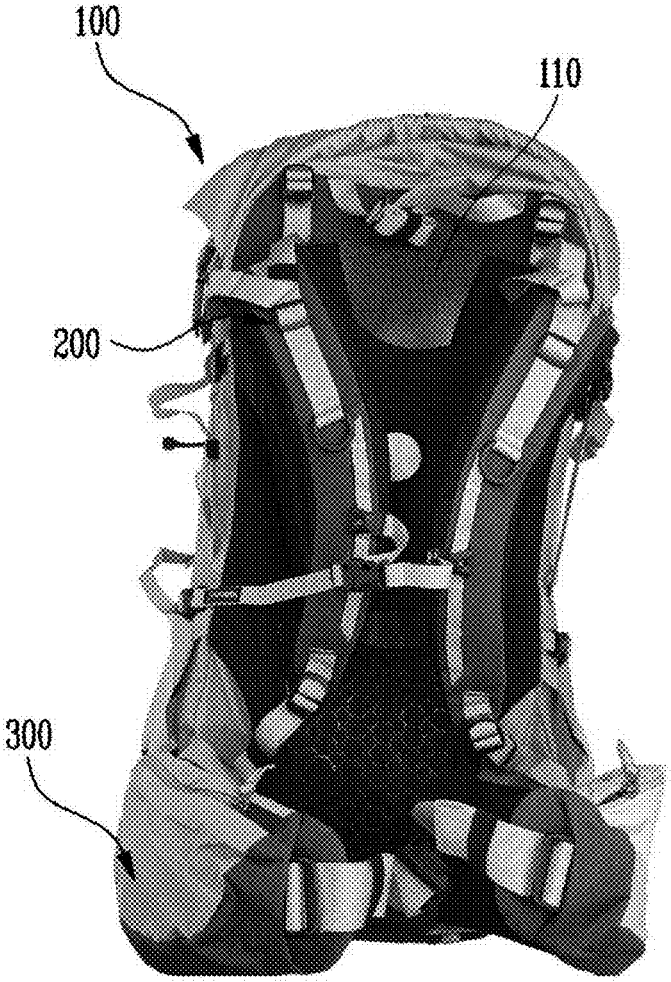
FIG. 1 shows an image for explaining a bag according to an embodiment of the present invention.

The objects, specific advantages, and novel features of the present invention will become more apparent from the following detailed description and preferred embodiments taken in conjunction with the accompanying drawings. In the present specification, when adding reference numerals to components in each drawing, it should be noted that the same components are given the same numbers as much as possible even when they are shown in different drawings. In addition, in describing the present invention, when it is considered that a detailed description of related known technology or configuration may unnecessarily obscure the gist of the present invention, the detailed description will be omitted.

Hereinafter, preferred embodiments of the present invention will be described in detail with reference to the attached drawings.

Figure 2:
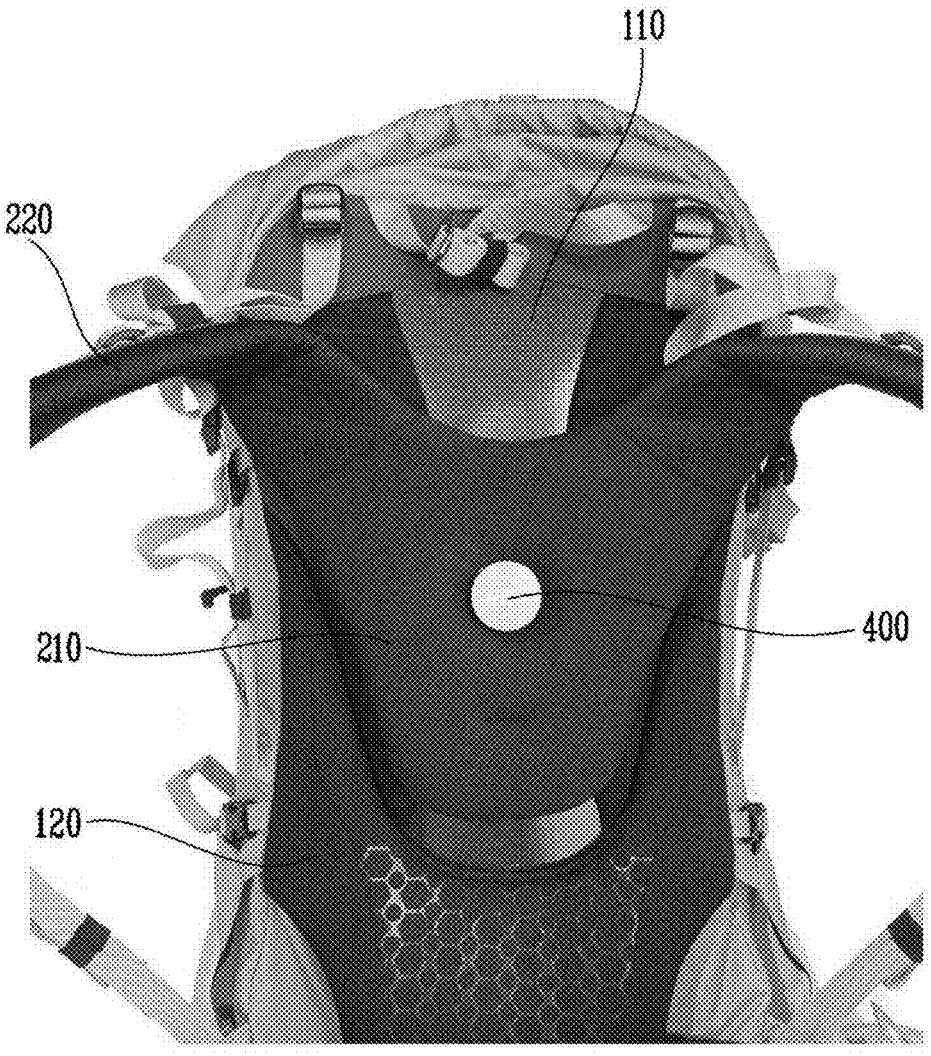
FIG. 2 shows an image for explaining a coupled state of a bag body and a shoulder slinging portion of the bag illustrated in FIG. 1.
Figure 3:
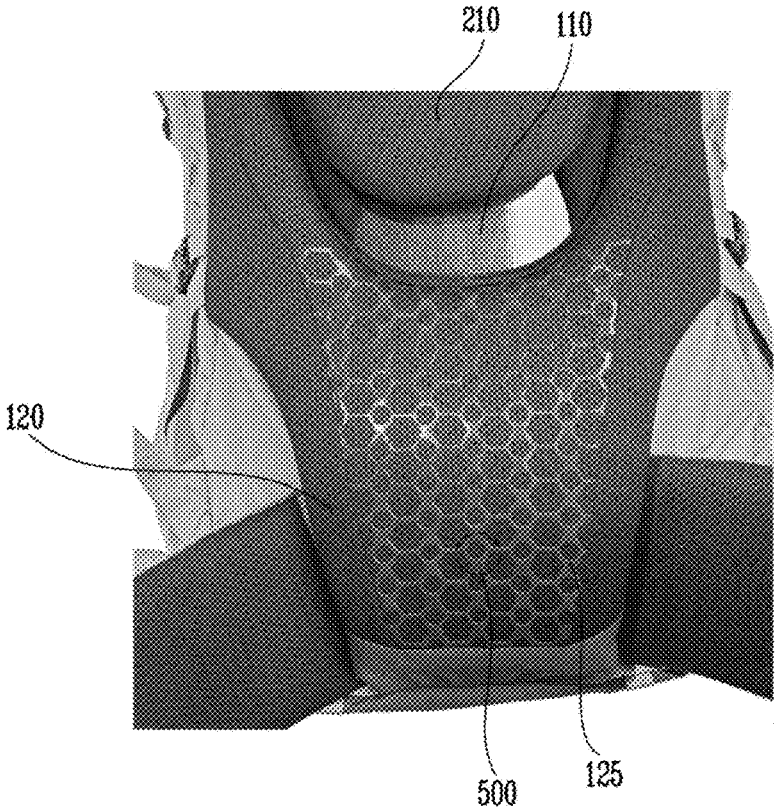
FIG. 3 shows an image for explaining a coupled state of a bag body and a waist belt portion of the bag illustrated in FIG. 1.
Figure 4:
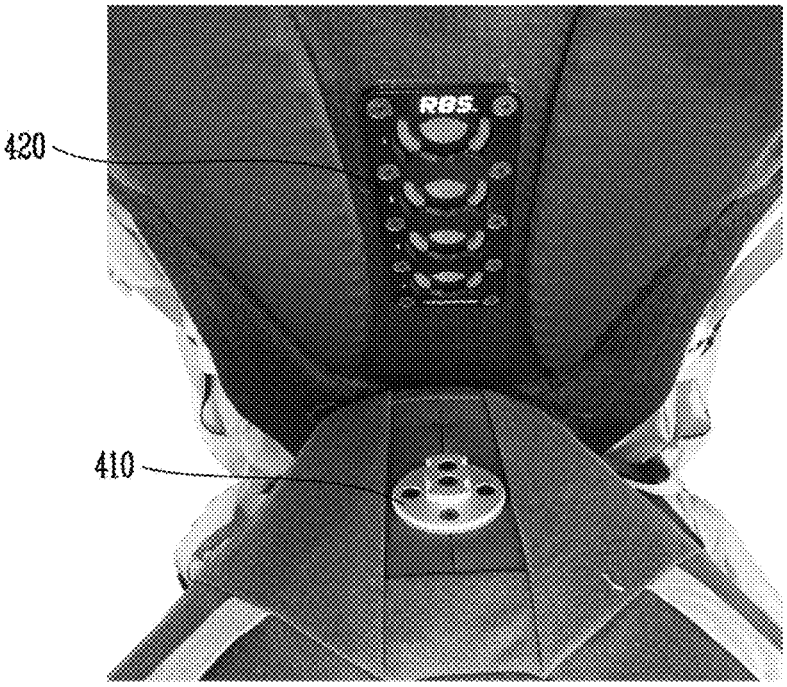
FIG. 4 shows an image of a separated state of a bag body and a shoulder slinging portion for explaining a first coupling portion according to one embodiment.
Figure 5:
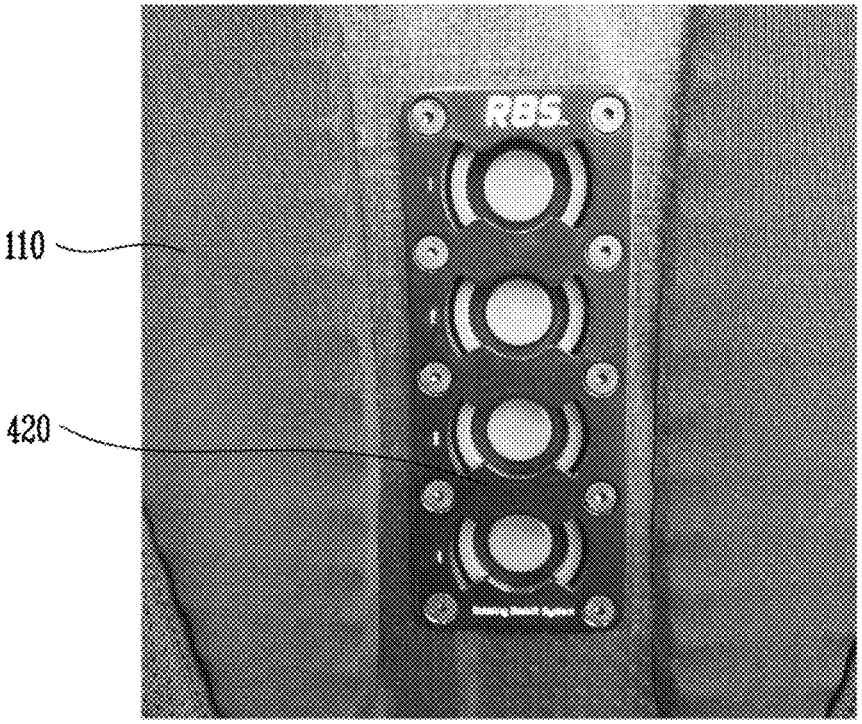
FIG. 5 shows an image for explaining a state in which a first body coupling portion of a first coupling portion is exposed to the outside of a bag body according to one embodiment.
Figure 6:
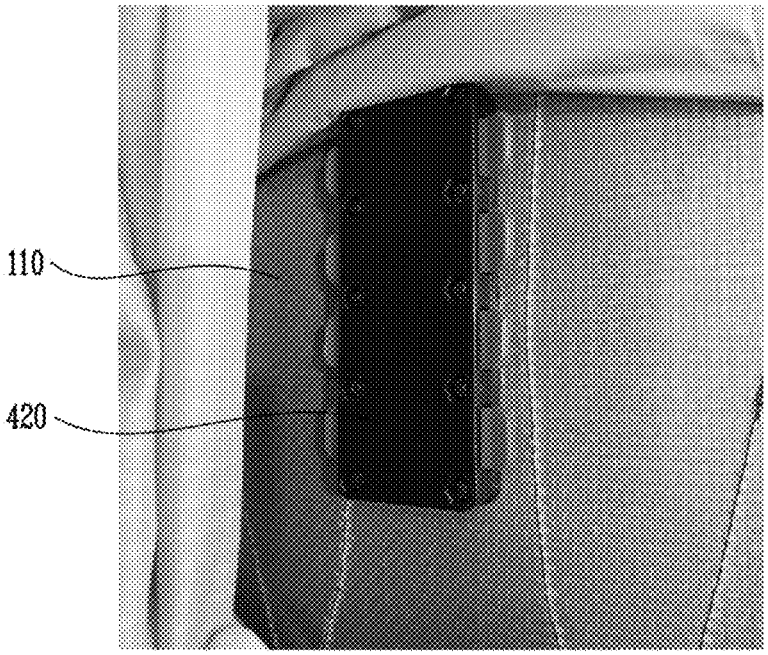
FIG. 6 shows an image for explaining a state in which a first body coupling portion of a first coupling portion is exposed to the inside of a bag body according to one embodiment.
Figure 7:
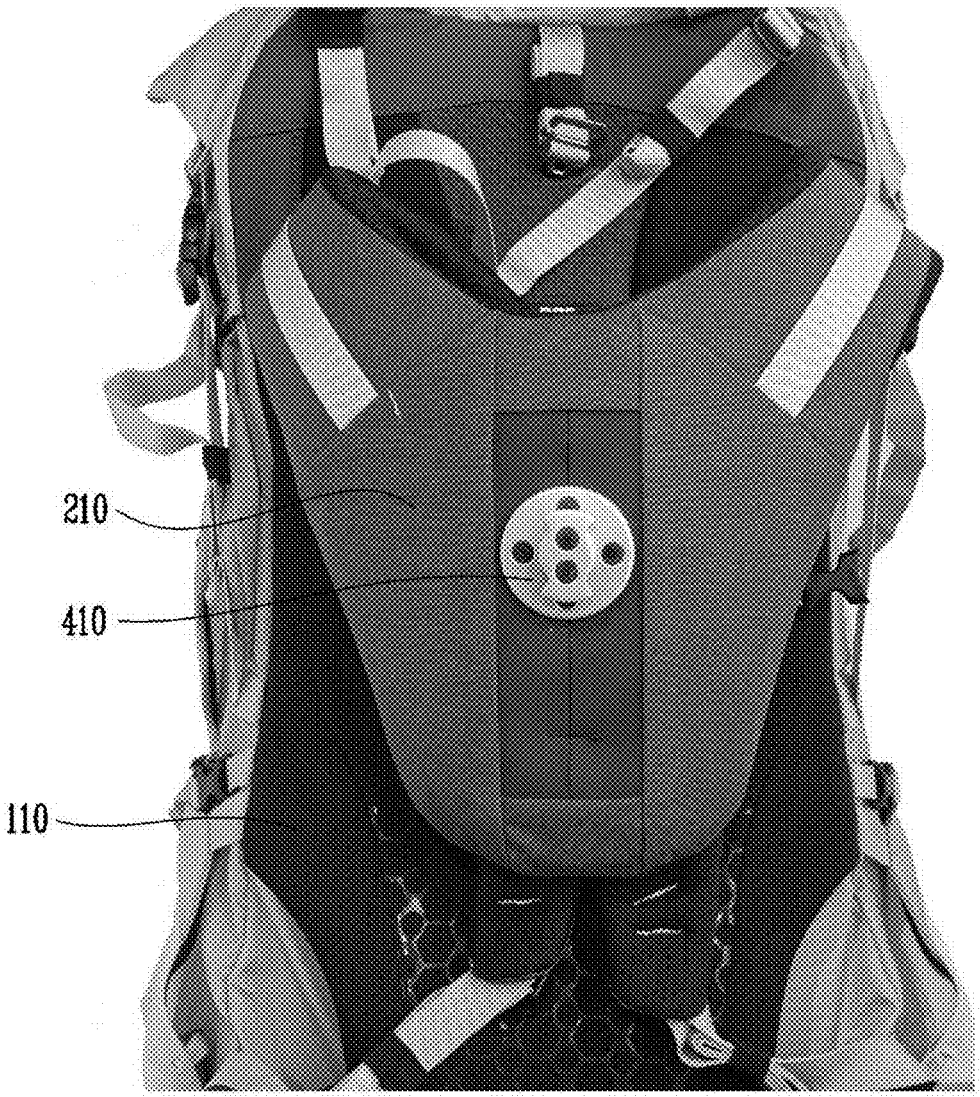
FIG. 7 shows an image for explaining a state in which a backrest coupling portion of a first coupling portion is coupled to a shoulder slinging portion according to one embodiment.
Figure 8:
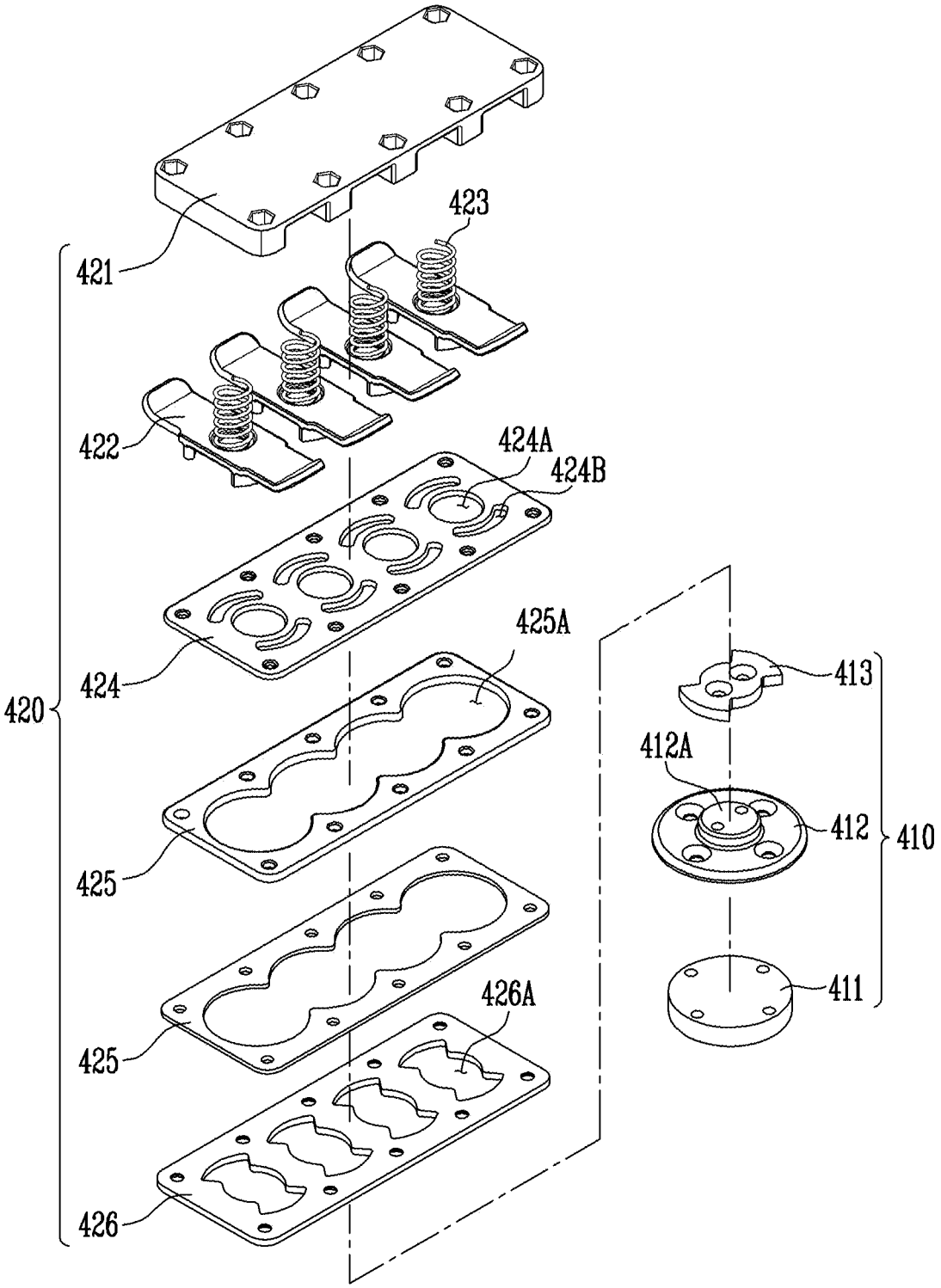
FIG. 8 shows an exploded perspective view of a first coupling portion according to one embodiment.
Figure 9:
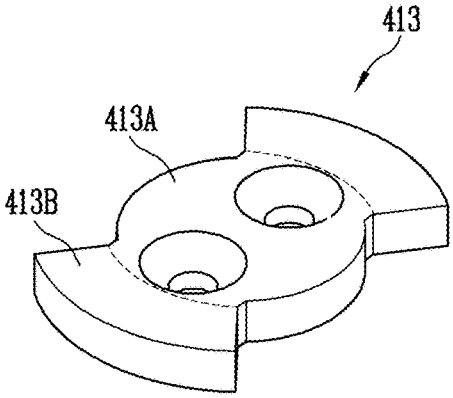
FIG. 9 shows a perspective view for explaining the rotational coupling body illustrated in FIG. 8.
Figure 10:
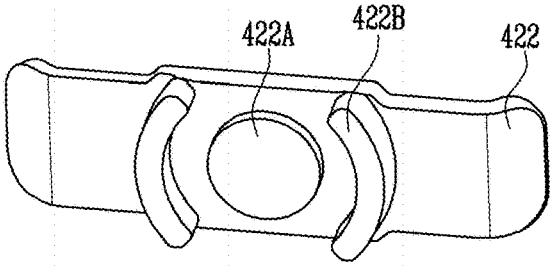
FIG. 10 shows a perspective view for explaining the rotation limiting portion illustrated in FIG. 8.
Figure 11:
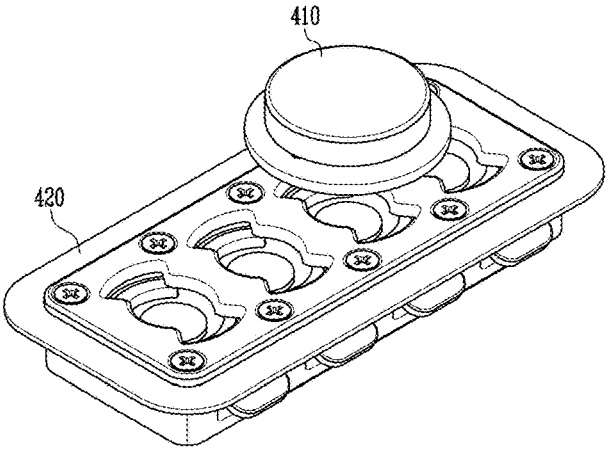
FIG. 11 shows an exploded perspective view of the rotational coupling body and the rotation limiting portion illustrated in FIG. 8.
Figure 12:
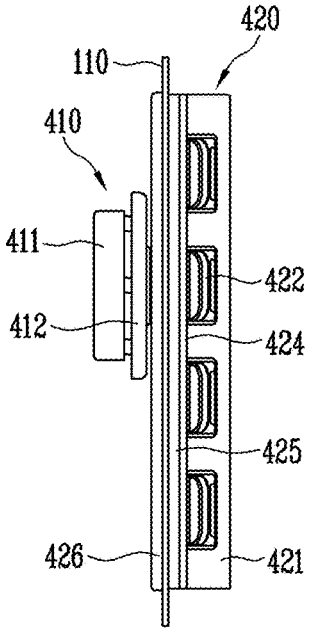
FIG. 12 shows a side view for explaining a coupled state of a backrest coupling portion of a first body coupling portion according to one embodiment.
Figure 13:
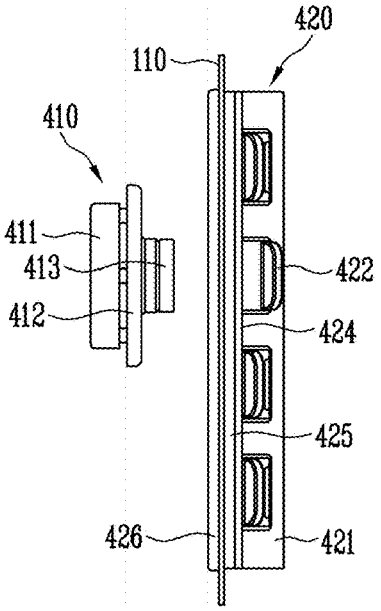
FIG. 13 shows a side view for explaining a separated state of a backrest coupling portion of a first body coupling portion according to one embodiment.
Figure 14:
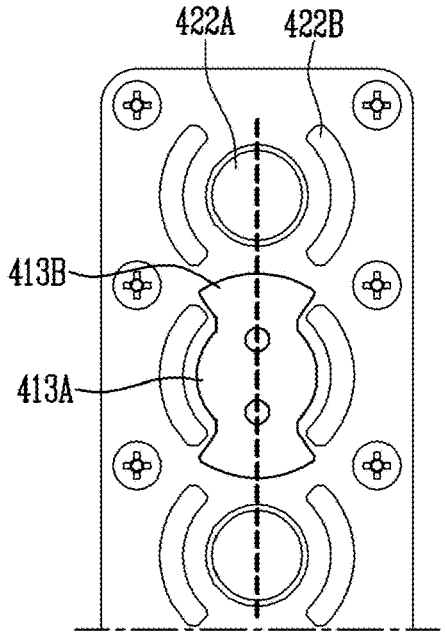
FIGS. 14 to 16 show diagrams for explaining rotation limitation of a rotational coupling body by a rotation limiting portion.
Figure 15:
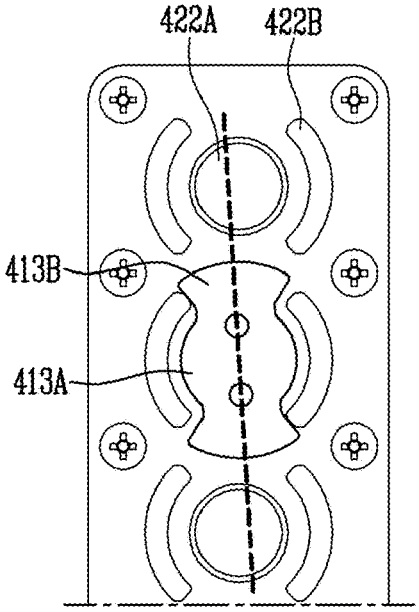
Figure 16:
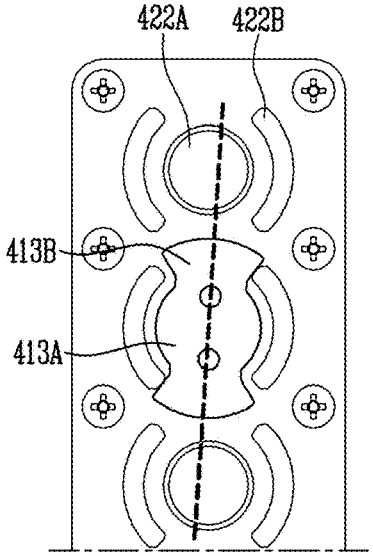
Figure 17:
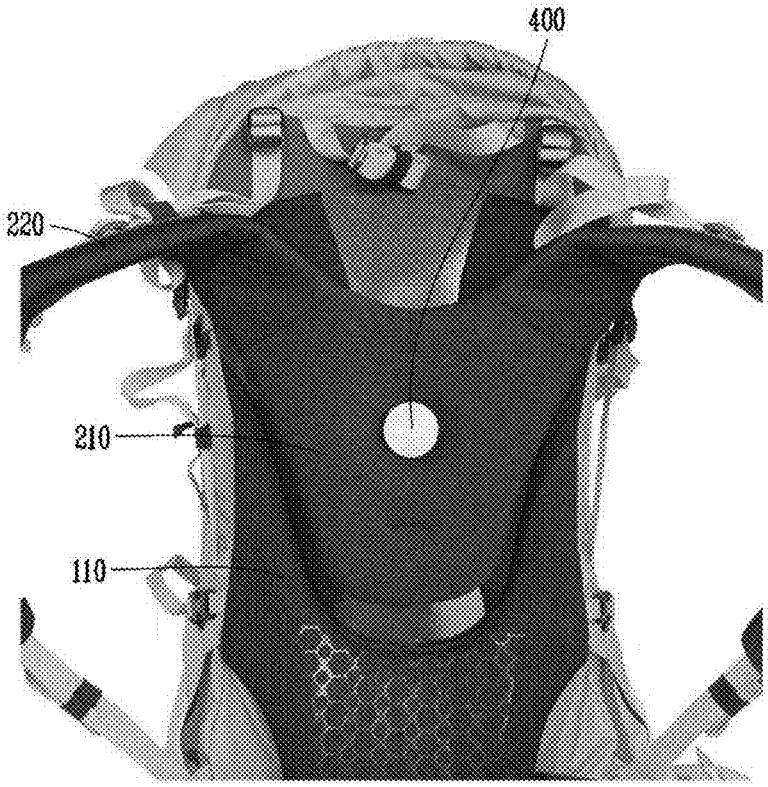
FIGS. 17 to 19 show images for explaining rotation of a shoulder slinging portion according to operation of the backrest coupling portion according to the rotation limitation of the rotational coupling body by the rotation limiting portion illustrated in FIGS. 14 to 16.
Figure 18:
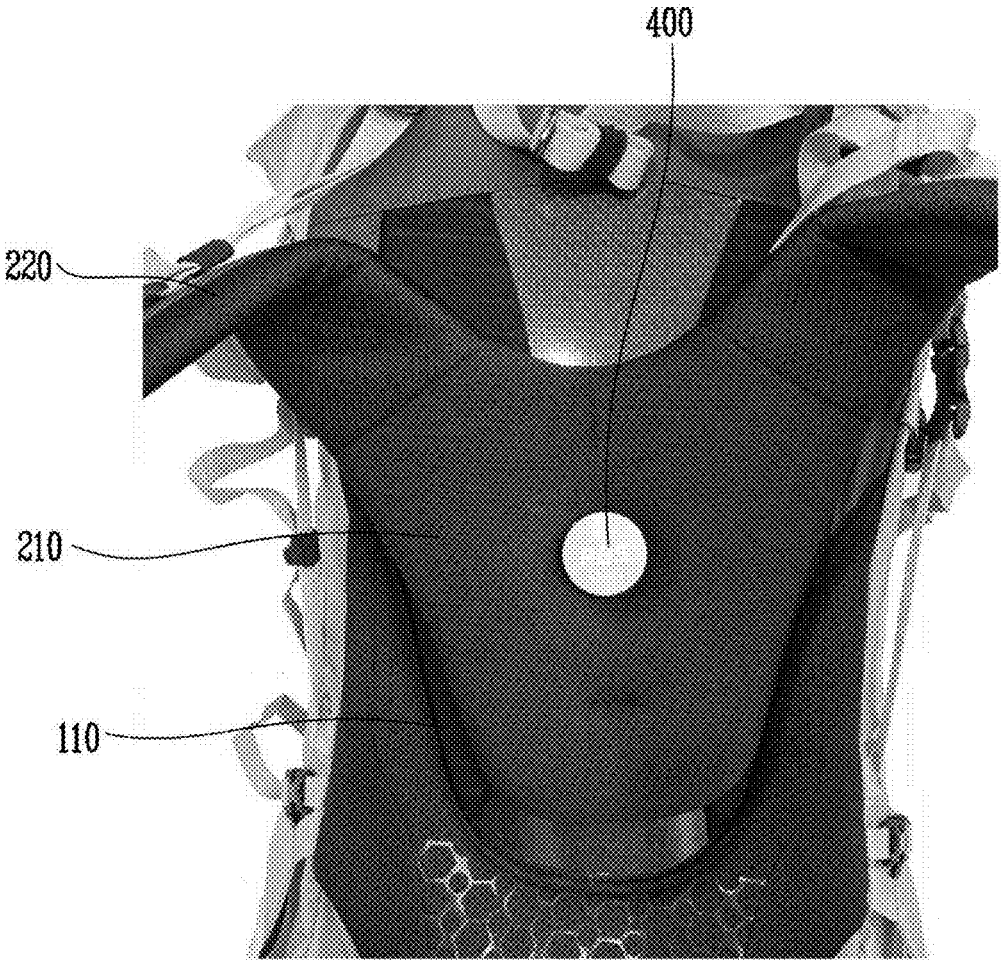
Figure 19:
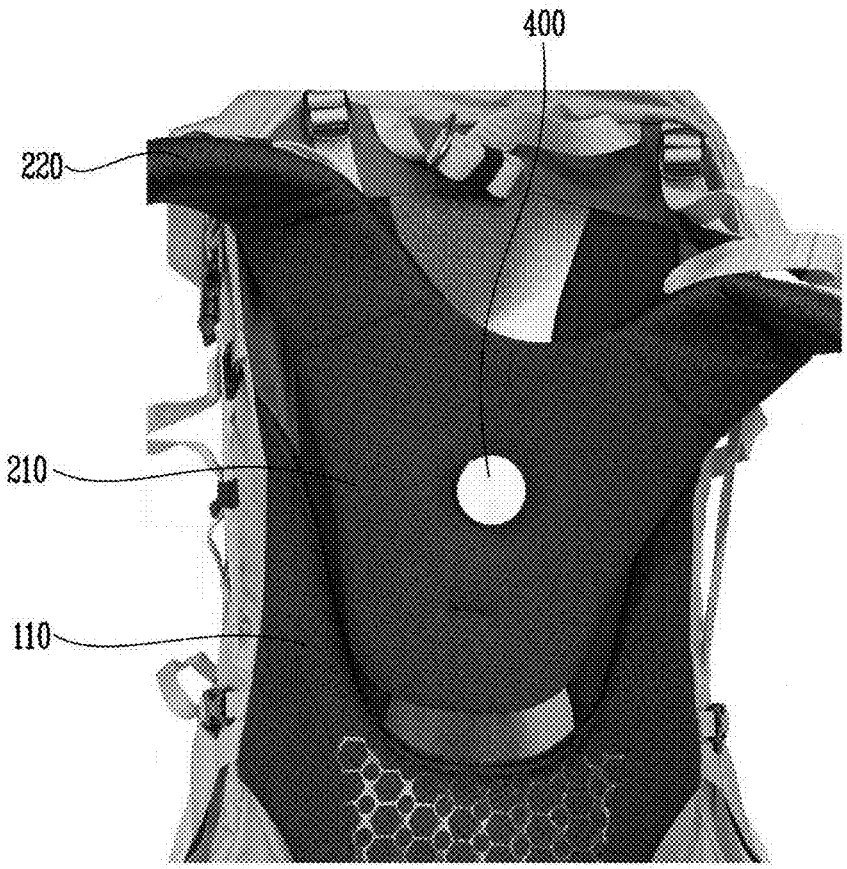
Figure 20:
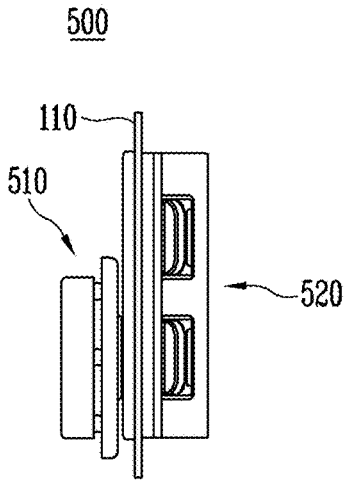
FIG. 20 shows a side view for explaining a second coupling portion according to one embodiment.

FIG. 1 shows an image for explaining a bag according to an embodiment of the present invention; FIG. 2 shows an image for explaining a coupled state of a bag body and a shoulder slinging portion of the bag illustrated in FIG. 1; FIG. 3 shows an image for explaining a coupled state of a bag body and a waist belt portion of the bag illustrated in FIG. 1; FIG. 4 shows an image of a separated state of a bag body and a shoulder slinging portion for explaining a first coupling portion according to one embodiment; FIG. 5 shows an image for explaining a state in which a first body coupling portion of a first coupling portion is exposed to the outside of a bag body according to one embodiment; FIG. 6 shows an image for explaining a state in which a first body coupling portion of a first coupling portion is exposed to the inside of a bag body according to one embodiment; FIG. 7 shows an image for explaining a state in which a backrest coupling portion of a first coupling portion is coupled to a shoulder slinging portion according to one embodiment; FIG. 8 shows an exploded perspective view of a first coupling portion according to one embodiment; FIG. 9 shows a perspective view for explaining the rotational coupling body illustrated in FIG. 8; FIG. 10 shows a perspective view for explaining the rotation limiting portion illustrated in FIG. 8; FIG. 11 shows an exploded perspective view of the rotational coupling body and the rotation limiting portion illustrated in FIG. 8; FIG. 12 shows a side view for explaining a coupled state of a backrest coupling portion of a first body coupling portion according to one embodiment; FIG. 13 shows a side view for explaining a separated state of a backrest coupling portion of a first body coupling portion according to one embodiment; FIGS. 14 to 16 show diagrams for explaining rotation limitation of a rotational coupling body by a rotation limiting portion; FIGS. 17 to 19 show images for explaining rotation of a shoulder slinging portion according to operation of the backrest coupling portion according to the rotation limitation of the rotational coupling body by the rotation limiting portion illustrated in FIGS. 14 to 16; and FIG. 20 shows a side view for explaining a second coupling portion according to one embodiment.

Referring to FIGS. 1 to 20, the bag may include a bag body 100, a shoulder slinging portion 200, a waist belt 300, a first coupling portion 400, and a second coupling portion 500.

A bag body 100 may have a storage space for storing items therein. In addition, a bag body 100 may be provided with a back plate portion 110 that may correspond to a user's body, for example, the back.

In addition, a waist cushion portion 120 capable of providing a cushioning sensation corresponding to a user's waist may be provided on a lower portion of the back plate portion 110 in the user direction. A slip preventing pattern 125 may be provided on the surface of the waist cushion portion 120 to prevent the bag from slipping by allowing the waist cushion portion to be in close contact with the user.

A part of a shoulder slinging portion 200 is connected to a bag body 100 so that a user may wear the bag. A shoulder slinging portion 200 may include a backrest portion 210 and a shoulder strap 220.

A backrest portion 210 may be in close contact with a user's back and may be coupled to a back plate portion 110 of a bag body 100 through a first coupling portion 400.

A shoulder strap 220 may have a ring shape connected to the top of a backrest 210 and the bottom of a bag body 100. A user may wear a bag using a shoulder strap 220.

A waist belt portion 300 may be provided corresponding to a lower portion of a back panel portion 110.

A waist belt portion 300 is shaped and configured to be worn around a user's waist and may support all or a part of the load of a bag body 100 (and its contents) on the user's body.

A waist belt portion 300 may be connected to the bottom of a back plate portion 110 through a second coupling portion 500. Meanwhile, in the present embodiment, it has been described as an example that the waist belt portion 300 is connected to the bottom of the back plate portion 110, but it is not limited thereto. For example, a waist belt portion 300 may be connected to a waist cushion portion 120 through a second coupling portion 500.

A first coupling portion 400 may connect a back plate portion 110 of a bag main body 100 and a backrest portion 210 of a shoulder slinging portion 200 in a height-adjustable manner. In addition, even if shaking of a user's body occurs when the user moves while wearing the bag, a first coupling portion 400 may maintain the posture of the bag constant.

A first coupling portion 400 may include a backrest coupling portion 410 coupled to a part of the shoulder slinging portion 200 and a first body coupling portion 420 coupled to a part of a bag body 100.

A backrest coupling portion 410 may be coupled to a backrest portion 210 of a shoulder slinging portion 200 and coupled to a first body coupling portion 420, thereby coupling the bag body 100 and the shoulder slinging portion 200.

A backrest coupling portion 410 may include a first fixture 411, a second fixture 412, and a rotational coupling body 413.

A first fixture 411 may be provided in the outside direction of a backrest portion 210, that is, in the direction of a user's body, and the first fixture 411 may be coupled to a second fixture 412 through a method such as screw coupling. In addition, a first fixture 411 may be provided in a circular shape, but is not limited thereto, and may have various shapes other than a circular shape.

A second fixture 412 may be provided in the direction of a back plate portion 110 of a backrest portion 210 and may be coupled to a first fixture 411. A second fixture 412 may be provided in a circular shape, but is not limited thereto, and may have various shapes other than a circular shape. In addition, a second fixture 412 may be provided with a protruding portion 412A provided on a surface facing a back plate 110. A protruding portion 412A may have a circular shape. Meanwhile, in the above, it has been described as an example that the protruding portion 412A has a circular shape, but it is not limited thereto. For example, a protruding portion 412A may have an elliptical or polygonal shape.

A rotational coupling body 413 may allow a backrest coupling portion 410 to be coupled to or separated from a first body coupling portion 420 through rotation. A rotational coupling body 413 may be coupled to a protruding portion 412A of a second fixture 412. A rotational coupling body 413 may be coupled to a second fixture 412 through a method such as screw coupling. Meanwhile, in the above, it has been described as an example that the rotational coupling body 413 is coupled to the second fixture 412 through screw coupling, but it is not limited thereto. For example, the rotational coupling body 413 and the second fixture 412 may have a structure in which they are coupled through a method such as welding, or may have an integrally formed structure.

A rotational coupling body 413 may have a central portion 413A having a shape corresponding to the protruding portion 412A, that is, a circular shape, and a wing portion 413B connected to both sides of the central portion 413A. A wing portion 413B may have a shape in which a part of a concentric circle having a larger diameter than the diameter of the central portion 413A is sectioned.

A first body coupling portion 420 may be coupled to a back plate portion 110 of a bag body 100. A first body coupling portion 420 may be coupled to a backrest coupling portion 410 and may include a plurality of coupling areas provided at different heights.

Hereinafter, a first body coupling portion 420 is described in more detail.

A first body coupling portion 420 may include a first base portion 421, a rotation limiting portion 422, an elastic member 423, a protruding place-in/place-out plate 424, a spacing plate 425, and a second base portion 426.

A first base portion 421 may be provided inside a storage space of a bag body 100. A first base portion 421 may be provided with a plurality of protrusions that allow for screw coupling with a second base portion 426. In the present embodiment, it has been described as an example that the first base portion 421 and the second base portion 426 are screwed together, but this is not limited thereto, and the first base portion 421 and the second base portion 426 may be coupled through various methods.

In addition, a first base portion 421 may be divided into a plurality of areas where a rotation limiting portion 422 is disposed by the protrusions. Here, the areas where the rotation limiter 422 is disposed may be arranged side by side in one direction, for example, a direction perpendicular to the ground.

A first base portion 421 may be coupled to a second base portion 426 to provide a space in which a rotation limiting portion 422 and an elastic member 423 may be accommodated.

A rotation limiting portion 422 may be provided inside a storage space of a bag body 100. A plurality of rotation limiting portions 422 may be provided. A rotation limiting portion 422 may have a plate shape extending in a direction perpendicular to the direction in which the areas where the rotation limiting portion 422 of the first base portion 421 is disposed are arranged. The length of a rotation limiting portion 422 may be longer than the length in a direction perpendicular to the direction in which the areas where the rotation limiting portion 422 of the first base portion 421 is disposed are arranged. In other words, both ends of a rotation limiting portion 422 may be exposed to a storage space through a space between the protrusions of a first base portion 421. In addition, a rotation limiting portion 422 may have a shape in which both ends are bent in the direction of a first base portion 421.

A rotation limiting portion 422 may include a plurality of protrusions 422A, 422B provided in a flat area. For example, the protrusions 422A, 422B may include a circular first protrusion 422A and second protrusions 422B provided on both sides of the first protrusion 422A. The second protrusions 422B may a shape in which a part of a concentric circle having a larger diameter than the diameter of the first protrusion 422A is sectioned. Here, the protruding height of the first protrusion 422A may be smaller than the protruding height of the second protrusions 422B. In addition, the arc length of the sectioned area other than the second protrusions 422B of the rotation limiting portion 422 may be larger than the arc length of a corresponding wing portion 413B of the rotational coupling body 413. Therefore, the rotational coupling body 413 may rotate within the range of the sectioned area between the second protrusions 422B. That is, accordingly, the second protrusions 422B may limit the rotation range of the rotational coupling body 413.

An elastic member 423 may be provided between a first base portion 421 and each rotation limiting portion 422. By an elastic member 423, a first protrusion 422A of a rotation limiting portion 422 may apply pressure to a central portion 413A of a rotational coupling body 413.

In addition, an elastic member 423 may return a rotation limiting portion 422 to its original position even when the position of the rotation limiting portion 422 changes.

A protrusion place-in/place-out plate 424 may be provided inside a storage space of a bag body 100. A protrusion place-in/place-out plate 424 may have open areas 424A, 424B corresponding to protrusions 422A, 422B of a rotation limiting portion 422. In other words, a first protrusion 422A and second protrusions 422B of a rotation limiting portion 422 may be placed in and placed out through the open areas 424A, 424B. To this end, the thickness of a protrusion place-in/place-out plate 424 may be smaller than the protruding height of a first protrusion 422A and second protrusions 422B.

A spacing plate 425 may be provided inside a storage space of a bag main body 100. A spacing plate 425 may provide a plurality of open rotation spaces 425A so that a rotational coupling body 413 may rotate. A spacing plate 425 may space apart a protrusion place-in/place-out plate 424 and a second base portion 426. The thickness of a spacing plate 425 may be greater than or equal to the thickness of a rotational coupling body 413.

In addition, a spacing plate 425 may be provided in a single number or a plural number, and the number may be selected as needed. When a plurality of spacing plates 425 are provided, the sum of the thicknesses of the plurality of spacing plates 425 may be greater than or equal to the thickness of a rotational coupling body 413.

A second base portion 426 may be provided outside a storage space of a bag body 100. A second base portion 426 may include a plurality of insertion areas 426A open in a shape corresponding to a rotational coupling body 413. The insertion area 426A may correspond to a coupling area of a first body coupling portion 420. In addition, a second base portion 426 may have a shape corresponding to a first base portion 421 and may be screwed to the first base portion 421.

A second coupling portion 500 may couple the back place portion 110 of a bag main body 100 and a waist belt portion 300. In addition, even if shaking of a user's body occurs when the user moves while wearing the bag, a second coupling portion 500 may maintain the posture of the bag constant.

A second coupling portion 500 may include: a waist belt coupling portion 510 coupled to a part of a waist belt portion 300; and a second body coupling portion 520 coupled to a part of a back plate portion 110. Here, the waist belt coupling portion 510 may be configured substantially the same as the backrest coupling portion 410 of the first coupling portion 400, and the second body coupling portion 520 may be configured the same as the first coupling portion 400 of the first body coupling portion 420. However, the second body coupling portion 520 may have a smaller coupling area compared to the first body coupling portion 420.

The waist belt coupling portion 510 may be configured substantially the same as the backrest coupling portion 410. That is, similar to the backrest coupling portion 410, the waist belt coupling portion 510 may include a first fixture 411 provided in the user direction of the waist belt portion 300; a second fixture 412 provided in the direction of the backrest portion 210 of the waist belt portion 300; and a rotational coupling body 413.

Hereinafter, a method of coupling a backrest coupling portion 410 and a first body coupling portion 420 will be described.

First, as shown in FIG. 13, in a state in which the rotational coupling body 413 of the backrest coupling portion 410 is separated, the rotational coupling body 413 of the backrest coupling portion 410 may be disposed to be correspond to an insertion area 426A at a position corresponding to the user's body among the insertion areas 426A of the second base portion 426.

Then, as shown in FIGS. 11 and 12, the user may insert the rotational coupling body 413 into the first body coupling portion 420 through the insertion area 426A.

When the rotational coupling body 413 is inserted into the first body coupling portion 420, the rotation limiting portion 422 may be pressurized to move in the direction of the backrest 210. That is, the first protrusion 422A and the second protrusion 422B of the rotation limiting portion 422 may enter into the open areas 424A, 424B of the protrusion place-in/place-out plate 424, so that the rotational coupling body 413 may rotate inside the first body coupling portion 420.

After a rotational coupling body 413 is inserted into a first body coupling portion 420, the rotational coupling body 413 may rotate within a rotation space 425A. When the rotational coupling body 413 rotates and an area other than a second protrusion 422B of a rotation limiting portion 422 corresponds to a wing portion 413B of the rotational coupling body 413, a first protrusion 422A and a second protrusion 422B of the rotation limiting portion 422 may protrude out of the open areas 424A, 424B of the protrusion place-in/place-out plate 424 by an elastic member 423. When the first protrusion 422A and the second protrusion 422B protrude out of the open areas 424A, 424B of the protrusion place-in/place-out plate 424, the first protrusion 422A and the second protrusion 422B may limit the rotation of the rotational coupling body 413, and as shown in FIG. 10, the backrest coupling portion 410 and the first body coupling portion 420 may be coupled and fixed. Accordingly, the bag body 100 and the shoulder holder 200 may be coupled.

As described above, a user may insert a rotational coupling body 413 into the insertion areas 426A, 426B at various positions. Therefore, a user may adjust the height of a shoulder slinging portion 200 to a height suitable for their own body. By adjusting the height of the shoulder slinging portion 200, the user may adjust the wearing sensation of the bag to be suitable for their own body.

Hereinafter, a method of separating a backrest coupling portion 410 and a first body coupling portion 420 is described.

First, in a state in which a rotational coupling body 413 of a backrest coupling portion 410 is coupled, a user moves a rotation limiting portion 422 inside the bag body 100 in the opposite direction of the back plate portion 110.

When the rotation limiting portion 422 moves in the opposite direction of the back plate portion 110, a first protrusion 422A and a second protrusion 422B may move into the open areas 424A, 424B of the protrusion place-in/place-out plate 424.

When the first protrusion 422A and the second protrusion 422B move into the open areas 424A, 424B of the protrusion place-in/place-out plate 424, the rotational coupling body 413 may be in a rotatable state.

After this, when the rotational coupling body 413 may be rotated so that the rotational coupling body 413 is disposed to correspond to the shape of the insertion areas 426A, 426B of the second base portion 426, the user may separate the backrest coupling portion 410 and the first body coupling portion 420.

When the backrest coupling portion 410 and the first body coupling portion 420 are separated, the bag body 100 and the shoulder slinging portion 200 may be separated.

Meanwhile, the arc length of the sectioned area other than a second protrusion 422B of the rotation limiting portion 422 may be larger than the arc length of a corresponding wing portion 413B of the rotational coupling body 413. Therefore, as shown in FIGS. 14 to 16, the rotational coupling body 413 may rotate within a predetermined angle range based on a direction parallel to the long side of a first base portion 421. For example, a rotational coupling body 413 may rotate within an angle range of more than 0° and less than or equal to 20°, based on a direction parallel to the long side of a first base portion 421.

As the rotational coupling body 413 may rotate in a predetermined angle range, as shown in FIGS. 17 to 19, the backrest portion 210 may rotate around the backrest coupling portion 410 within an angle range of more than 0° and less than or equal to 20°, based on a direction parallel to the long side of the first base portion 421.

As described above, as the rotational coupling body 413 of the first coupling portion 400 and the second coupling portion 500 is rotatable within a certain angle range, even if shaking of a user's body occurs when the user moves while wearing the bag, the bag body 100 may maintain a state of being perpendicular to the ground.

Accordingly, even when a user of the bag stores a heavy item in the bag body 100 and wears the bag, a less burden may be placed on the user's body.

Figure 21:
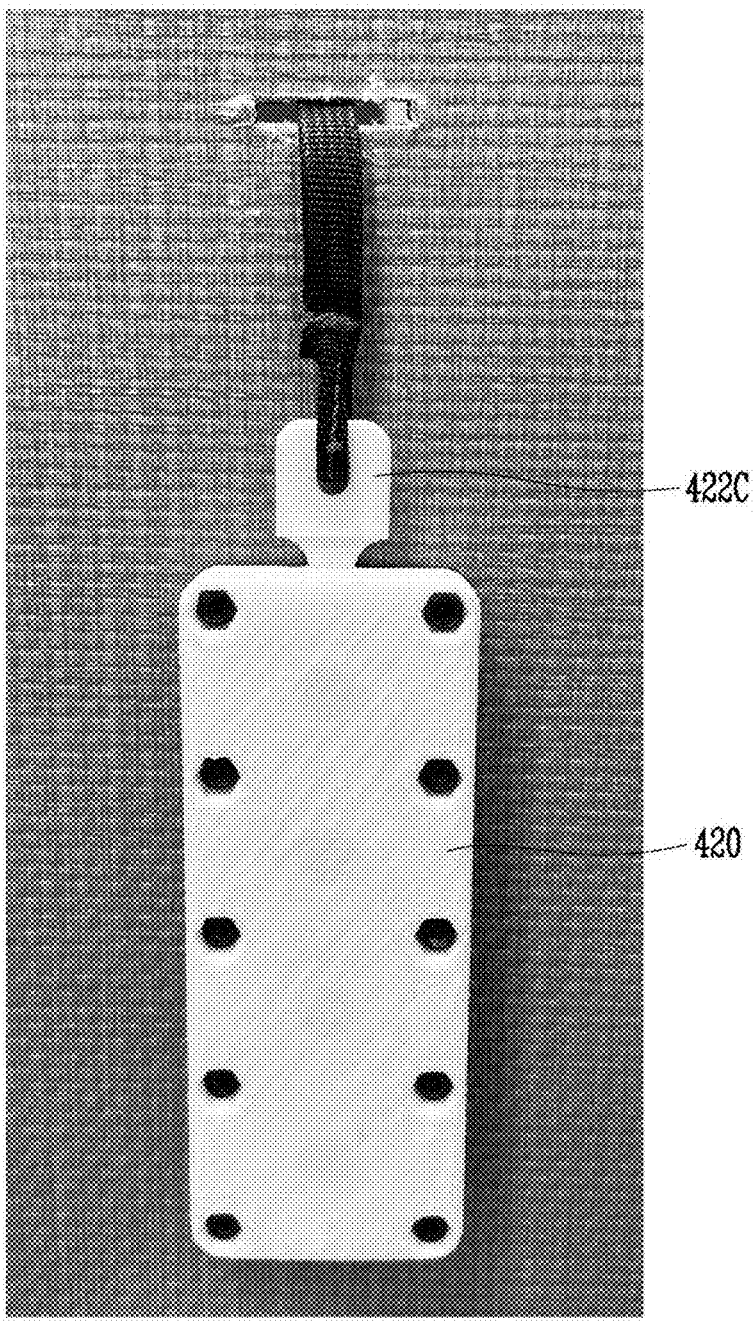
FIG. 21 shows an image for explaining a state in which a first body coupling portion of a first coupling portion is exposed to the inside according to another embodiment.
Figure 22:
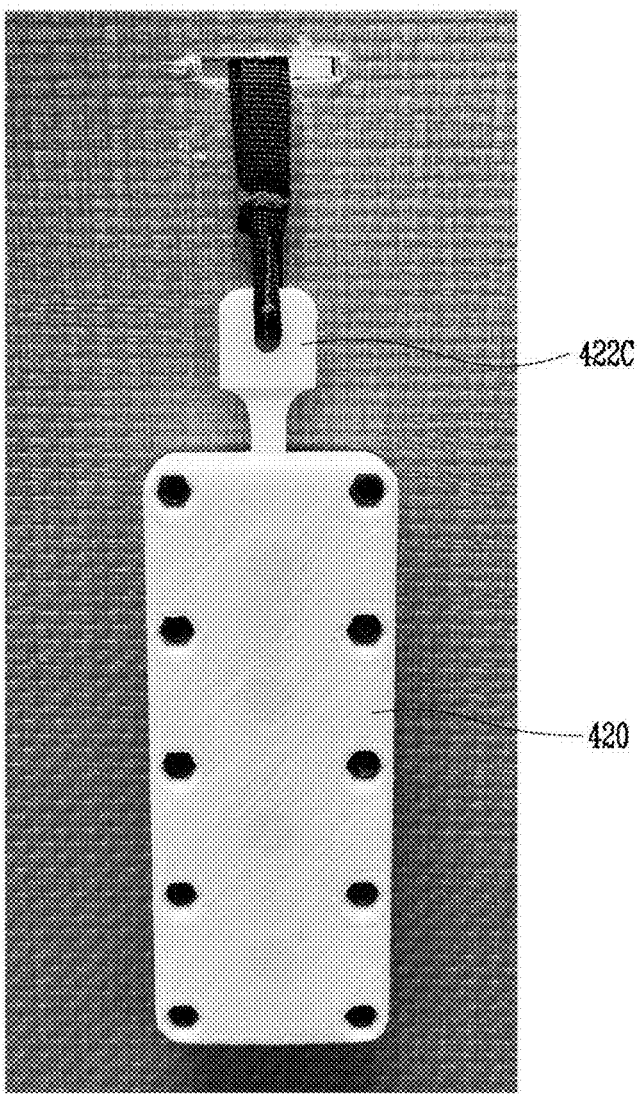
FIG. 22 shows an image for explaining a situation in which a protrusion adjusting portion is operated while a first body coupling portion of a first coupling portion is exposed to the inside according to another embodiment.
Figure 23:
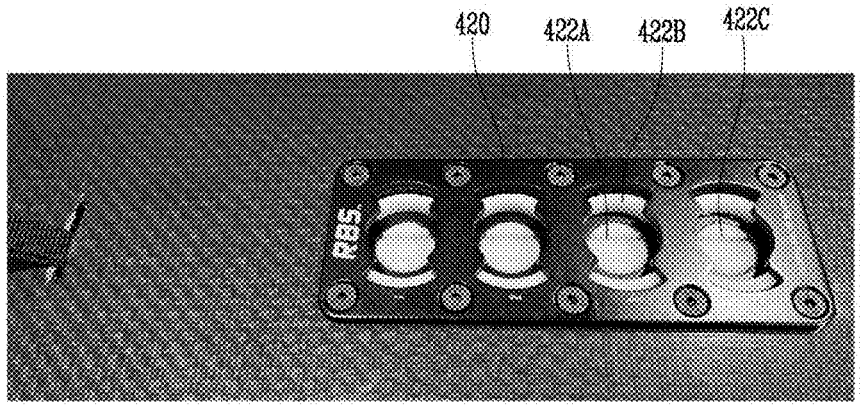
FIG. 23 shows an image for explaining a situation in which a protrusion adjusting portion is not operated while a first body coupling portion of a first coupling portion is exposed to the outside according to another embodiment.
Figure 24:
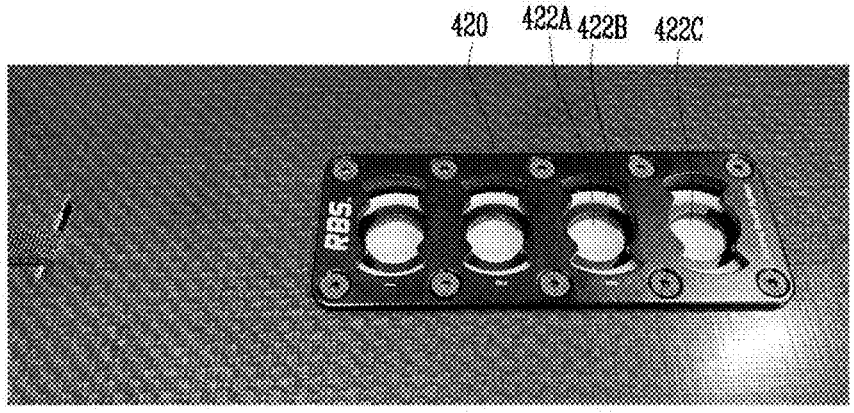
FIG. 24 shows an image for explaining a situation in which a protrusion adjusting portion is operated while a first body coupling portion of a first coupling portion is exposed to the outside according to another embodiment.
Figure 25:
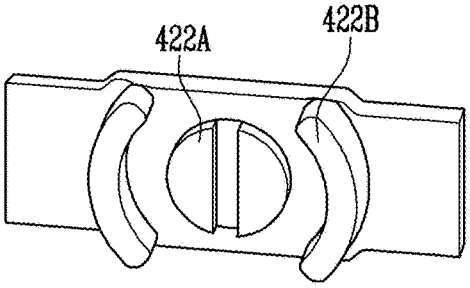
FIG. 25 shows a perspective view for explaining a rotation limiting portion according to another embodiment.
Figure 26:
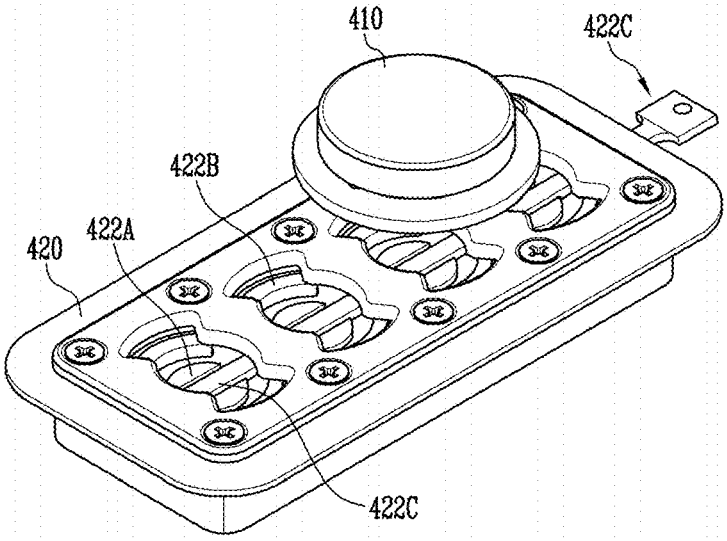
FIG. 26 shows an exploded perspective view of a first body coupling portion and a backrest coupling portion according to another embodiment.
Figure 27:
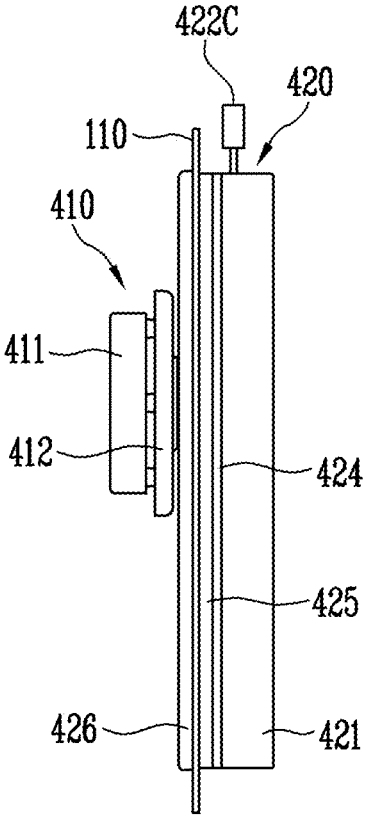
FIG. 27 shows a side view for explaining a coupled state of a first body coupling portion and a backrest coupling portion according to another embodiment.
Figure 28:
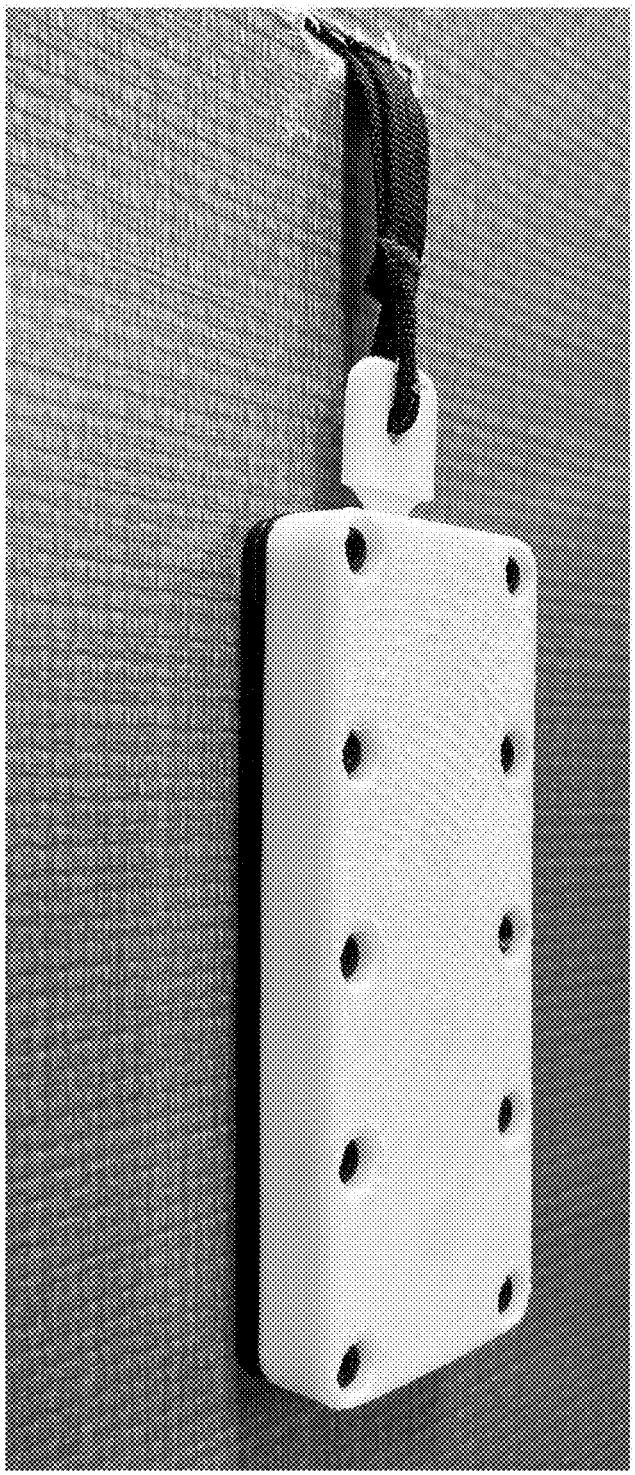
FIG. 28 shows an image for explaining a side in a state in which a first body coupling portion of a first coupling portion is exposed to the inside according to another embodiment.

FIG. 21 shows an image for explaining a state in which a first body coupling portion of a first coupling portion is exposed to the inside according to another embodiment; FIG. 22 shows an image for explaining a situation in which a protrusion adjusting portion is operated while a first body coupling portion of a first coupling portion is exposed to the inside according to another embodiment; FIG. 23 shows an image for explaining a situation in which a protrusion adjusting portion is not operated while a first body coupling portion of a first coupling portion is exposed to the outside according to another embodiment; FIG. 24 shows an image for explaining a situation in which a protrusion adjusting portion is operated while a first body coupling portion of a first coupling portion is exposed to the outside according to another embodiment; FIG. 25 shows a perspective view for explaining a rotation limiting portion according to another embodiment; FIG. 26 shows an exploded perspective view of a first body coupling portion and a backrest coupling portion according to another embodiment; FIG. 27 shows a side view for explaining a coupled state of a first body coupling portion and a backrest coupling portion according to another embodiment; and FIG. 28 shows an image for explaining a side in a state in which a first body coupling portion of a first coupling portion is exposed to the inside according to another embodiment.

Hereinafter, another embodiment will be described, focusing on differences from the previously described embodiment.

In the first body coupling portion 420 of the first coupling portion 400 according to one embodiment, the first base portion 421 could be divided into a plurality of areas where the rotation limiting portion 422 may be disposed on a side surface. In addition, the rotation limiting portion 422 could have a plate shape extending in a direction perpendicular to the direction in which the areas in which the rotation limiting portion 422 is disposed are arranged.

In contrast, in a first body coupling portion 420 of a first coupling portion 400 according to another embodiment, a first base portion 421 may not be provided with a plurality of areas on a side surface.

In other words, since the rotation limiting portion 422 according to another embodiment may not have a plate shape extending in the vertical direction, as shown in FIG. 28, a side surface of the first base portion 421 according to another embodiment may not include an area for disposing the extended plate shape and may form a closed space.

A first coupling portion 400 according to another embodiment may be provided with a rear surface in a sealed form, but a protrusion adjusting portion 422C that is further provided may penetrate the first coupling portion 400 according to another embodiment.

A protrusion adjusting portion 422C may be disposed to penetrate a first base portion 421 and a first protrusion 422A, and may be mechanically connected to protrusions 422A, 422B.

A protrusion adjusting portion 422C may be operated according to a change of position, and when the position of the protrusion adjusting portion 422C changes, movement may occur together with the mechanically connected protrusions 422A, 422B. Referring to FIGS. 21 and 22, FIG. 21 shows a situation in which the protrusion adjusting portion 422C is not operated, and FIG. 22 shows a situation in which the protrusion adjusting portion 422C is operated.

According to FIG. 22, the protrusion adjusting portion 422C operates while rising in the vertical direction, but it may also operate while descending or moving left and right depending on the design. In addition, according to FIG. 22, the protrusion adjusting portion 422C was connected to an adjustment string (not shown) and operated while rising in the vertical direction. The position of the adjustment strap may vary depending on a user's convenience, and instead of an adjustment strap, various devices such as buttons that may adjust the protrusion adjusting portion 422C are available.

FIG. 23 shows a situation in which the protrusion adjusting portion 422C is not operated, and FIG. 24 shows a situation in which the protrusion adjusting portion 422C is operated.

In a situation in which a protrusion adjusting portion 422C is not operated, a first protrusion 422A may protrude while being penetrated by the protrusion adjusting portion 422C, and a second protrusion 422B may also protrude. There may be a difference in the relative protruding height of a first protrusion 422A and a protrusion adjusting portion 422C, but in a situation in which a protrusion adjusting portion 422C is not operated, the protruding height of a first protrusion 422A may be higher than that of a protrusion adjusting portion 422C.

Referring to FIG. 24, in a situation in which a protrusion adjusting portion 422C is operated, the protruding height of a first protrusion 422A and a second protrusion 422B may be lowered or they may move inward, and the protruding height of a first protrusion 422A may be lowered compared to the protrusion adjusting portion 422C.

In a situation in which a protrusion adjusting portion 422C is operated, as the protruding height of protrusions 422A, 422B is lowered, the movement of the rotational coupling body 413, which limited the rotation range of the protrusions 422A, 422B, may become free. Therefore, the rotational coupling body 413 may freely rotate to be disposed corresponding to the shape of an insertion area 426A to be separated from the inside of a first body coupling portion 420.

In other words, in the first body coupling portion 420 according to one embodiment, the rotation limiting portion 422 could be moved in the opposite direction of the back plate 110 to move the first protrusion 422A and the second protrusion 422B into the open areas 424A, 424B, so that the rotational coupling body 413 could be in a rotatable state. The rotation limiting portion 422 was exposed to the inside of the bag body, and so it could be operated by opening the bag or through a separate device connected to the rotation limiting portion 422.

On the other hand, a first body coupling portion 420 according to another embodiment is simple because it may simultaneously move a plurality of first protrusions 422A and second protrusions 422B through movement of a protrusion adjusting portion 422C, and the rotational coupling body 413 may be separated at the same time.

By operating a protrusion adjusting portion 422C, a plurality of first protrusions 422A and second protrusions 422B may simultaneously move to the inside, but as a plurality of protrusion adjusting portions 422C are prepared or a single protrusion adjusting portion 422C is disposed depending on the design, each of the first protrusion 422A and the second protrusion 422B may independently move to the inside.

The present invention is not limited to the above-described embodiments and may, of course, include a combination of at least two or more of the above embodiments or a combination of at least one of the above embodiments and a known technology as a new embodiment.

Although the present invention has been described in detail through specific embodiments, these are for specifically explaining the present invention, and the present invention is not limited thereto, and it is clear that modifications and improvements thereof are possible by those skilled in the art within the technical spirit of the present invention.

All simple modifications or changes of the present invention fall within the scope of the present invention, and the specific scope of protection of the present invention will be made clear by the appended claims.

The invention claimed is:

1. A bag comprising:

a bag body provided with a back plate portion and a storage space for storing items;

a shoulder slinging portion including a backrest portion corresponding to the back plate portion and a shoulder strap connected to the backrest portion; and a first coupling portion connecting the back plate portion and the backrest portion in a height-adjustable manner, wherein the first coupling portion includes: a first body coupling portion coupled to the back plate portion; and a backrest coupling portion coupled to the backrest portion and the first body coupling portion includes a plurality of coupling areas to which the backrest coupling portion is coupled and provided at different heights, wherein the backrest coupling portion includes:

a first fixture provided in an outside direction of the backrest portion;

a second fixture provided in a direction of the back plate portion and provided with a circular protruding portion provided in the direction of the back plate portion, and a rotational coupling body coupled to the circular protruding portion.

2. The bag according to claim 1, wherein the rotational coupling body has a central portion having a shape corresponding to the circular protruding portion; and a wing portion connected to both sides of the central portion.

3. The bag according to claim 2, wherein the wing portion has a shape in which a part of a concentric circle having a larger diameter than the diameter of the central portion is sectioned.

4. The bag according to claim 2, wherein the first body coupling portion includes:

a first base portion provided inside the storage space and divided into a plurality of areas arranged in one direction;

a plurality of rotation limiting portions including a first protrusion corresponding to the central portion and second protrusions provided on both sides of the first protrusion to limit rotation of the wing portion, and disposed in each of the areas;

a plurality of elastic members provided at the different heights, wherein each of the elastic members are provided between the first base portion and the rotation limiting portions;

a protrusion place-in/place-out plate including open areas corresponding to the first protrusion and the second protrusions to allow the first protrusion and the second protrusions to be placed in and out, and provided inside the storage space;

a spacing plate providing a plurality of open rotation spaces to allow the rotational coupling body to rotate and provided inside the storage space; and a second base portion including a plurality of insertion areas that correspond to the coupling area of the first body coupling portion and are open in a shape corresponding to the rotational coupling body.

5. The bag according to claim 4, wherein the protruding height of the first protrusion is smaller than the protruding height of the second protrusions.

6. The bag according to claim 5, wherein the second protrusions of the rotation limiting portion have a shape in which a part of a concentric circle having a larger diameter than the diameter of the central portion is sectioned, and are smaller than the width of the wing portion of the rotational coupling body.

7. The bag according to claim 4, wherein the rotation limiting portion may have a shape extending in a direction perpendicular to the direction in which the areas of the first base portion are arranged, and the first protrusion and the second protrusions may be provided in a flat area of the rotation limiting portion.

8. The bag according to claim 4, wherein the thickness of the protrusion place-in/place-out plate is smaller than the protruding heights of the first protrusion and the second protrusions.

9. The bag according to claim 4, further comprising:

a waist belt portion provided corresponding to the lower portion of the back plate portion; and a second coupling portion connecting the waist belt portion and the back plate portion, wherein the second coupling portion includes a waist belt coupling portion coupled to a part of the waist belt portion and having the same configuration as the backrest coupling portion; and a second body coupling portion having substantially the same structure as the first body coupling portion but having a smaller coupling area than the coupling area of the body coupling portion.

10. The bag according to claim 2, wherein the first body coupling portion includes:

a first base portion provided inside the storage space and forming a closed space;

a plurality of rotation limiting portions including a first protrusion corresponding to the central portion and including an empty space therein, and second protrusions provided on both sides of the first protrusion to limit rotation of the wing portion;

a protrusion adjusting portion penetrating the first base portion, engaging with the empty space of the first protrusion, and connected to the first protrusion and the second protrusions;

a plurality of elastic members provided at the different heights, wherein each of the elastic members are provided between the first base portion and the rotation limiting portions;

a protrusion place-in/place-out plate including open areas corresponding to the first protrusion and the second protrusions to allow the first protrusion and the second protrusions to be placed in and out, and provided inside the storage space;

a spacing plate providing a plurality of open rotation spaces to allow the rotational coupling body to rotate and provided inside the storage space; and a second base portion including a plurality of insertion areas that correspond to the coupling area of the first body coupling portion and are open in a shape corresponding to the rotational coupling body.

11. The bag according to claim 10, wherein the protruding height of the first protrusion and the second protrusions is lowered by the operation of the protrusion adjusting portion, so that the rotational coupling body rotates in the plurality of open insertion areas.

12. The bag according to claim 1, further comprising:

a waist cushion portion attached to the lower portion of the back plate portion; and a slip preventing pattern provided on the surface of the waist cushion portion.

* * * * *